US006464104B1

(12) United States Patent
Waddell

(10) Patent No.: US 6,464,104 B1
(45) Date of Patent: Oct. 15, 2002

(54) VENDING SYSTEM

(76) Inventor: Gregory Waddell, 4126 Chelmsford Dr., Tallahassee, FL (US) 32308

( * ) Notice: Subject to any disclaimer, the term of this patent is extended or adjusted under 35 U.S.C. 154(b) by 0 days.

(21) Appl. No.: 09/168,443

(22) Filed: Oct. 8, 1998

(51) Int. Cl.[7] ..... A24F 27/14
(52) U.S. Cl. ..... 221/150 A; 221/195
(58) Field of Search ..... 221/150 A, 150 HC, 221/150 R, 92, 131, 192, 191, 194, 195, 2, 7, 9, 13

(56) References Cited

U.S. PATENT DOCUMENTS

| | | | | |
|---|---|---|---|---|
| 4,004,712 A | | 1/1977 | Pond | 221/150 A |
| 4,762,250 A | | 8/1988 | Friberg | 221/123 |
| 5,105,979 A | * | 4/1992 | Bakx et al. | 221/150 HC |
| 5,209,373 A | | 5/1993 | Hondel et al. | 221/150 HC |
| 5,285,041 A | | 2/1994 | Wright | 219/717 |
| 5,503,300 A | | 4/1996 | Prescott et al. | 221/273 |
| 5,522,310 A | | 6/1996 | Black, Sr. et al. | 99/357 |
| 5,555,793 A | | 9/1996 | Tocchet et al. | 99/326 |
| 5,566,856 A | | 10/1996 | Fallen et al. | 221/150 HC |
| 5,579,952 A | | 12/1996 | Fiedler et al. | 221/150 A |
| 5,582,758 A | | 12/1996 | Smith et al. | 219/681 |
| 5,589,093 A | | 12/1996 | Chen | 219/679 |
| 5,641,050 A | | 6/1997 | Smith et al. | 194/210 |
| 5,651,476 A | | 7/1997 | Perry et al. | 221/131 |
| 5,688,423 A | | 11/1997 | Rudewicz et al. | 219/501 |
| 5,706,976 A | | 1/1998 | Purkey | 221/6 |
| 5,997,924 A | * | 12/1999 | Olander, Jr. et al. | 221/150 H |

* cited by examiner

*Primary Examiner*—Kenneth W. Noland
(74) *Attorney, Agent, or Firm*—Peter Loffler

(57) ABSTRACT

A vending system has at least one storage compartment with at least one shelf for holding various food packets. A computer system, which may be linked to a remote sight, stores information about each food packet within the system, which information is made available to a user via a video display device and appropriate controls. Once a user selects food packets for purchase, the vending system accepts and verifies payment and thereafter causes a delivery system to deliver the food packets to a heating compartment which provides appropriate heat to properly heat the food packet. Multiple food packets can be heated simultaneously with heating of each terminating nearly simultaneously. Thereafter, the user is free to retrieve the purchased food packets.

72 Claims, 6 Drawing Sheets

24
22
10
22
20
28
28
28
28
66
50
56
64
26

10
14
20
62
52
66
28
18
64
12
56
26
16

14
22
10
22
46
20
52
58
62
44
48
36
38
32
30
34
28
64
50
26
16

VENDING SYSTEM

BACKGROUND OF THE INVENTION

1. Field of the Invention

The present invention relates to a multifunction vending system capable of delivering multiple heated or non-heated food packets.

2. Background of the Prior Art

Vending machines come in many forms. Some deliver dry packaged goods such as candy and chips. Such vending machines typically have a transparent front panel through which a user can see the available choices and therefrom make his selection. Other vending machines are capable of delivering a cold food product such as a soda or ice cream or sandwich. Typically, such machines drop the selected food item from a refrigerator or freezer compartment to the user or allow a user to reach into the compartment via an access door. Other vending machines can deliver hot items such as coffee or soup. These machines typically drop a mix of some form into a cup and thereafter add heated water to the cup, the result being the food item purchased. Still other machines will deliver a cold or frozen food item to a user with the user thereafter inserting the food item into a nearby microwave oven for heating of the food item.

While these and other types of vending machines are well suited for specific applications such as soda delivery, they fail to address the needs of a user who wants a full, ready to consume meal delivered by the vending machine. Therefore, there is a need in the art for a vending system that is capable of delivering a full meal, containing hot items, cold items or both to a user in ready to consume form. Such a machine should allow a user to select food items from a variety of food items and once selected, automatically retrieve the food items and thereafter deliver them, after applying appropriate heat if required, to the user. Such a device should be of relatively straightforward design and construction utilizing standard vending machine and other technologies wherever appropriate. The vending system should be relatively simple to use. Advantageously, such a system will collect information for marketing, inventory, and control purposes.

SUMMARY OF THE INVENTION

The vending system of the present invention addresses the aforementioned needs in the art. The vending system provides for a device that store a multiple number of different food packets that may be consumed hot, cold, or both and allows a user to select one or more of such food items for purchase. After purchase, the vending system automatically retrieves each purchased food item and delivers each to a heating compartment, if necessary, applies the appropriate heat, and thereafter allows the user to retrieve the purchased food items. The vending system of the present invention utilizes standard vending system design concepts and is of straightforward complexity. The system collects information and delivers the information to a remote site.

The vending system of the present invention is comprised of a housing having a plurality of walls and at least one storage compartment—which may be cooled—each having at least one diagonally shelf, disposed therein. A heating compartment, such as a microwave oven is disposed within the housing. Openings are provided on one of the walls for user access into the heating compartments for retrieval of purchased food packets. A selection system allows a user to select at least one food packet for purchase. At least one delivery system delivers the purchased food packets to the user via the heating compartment.

The selection system is comprised of a database capable of storing a description, weight information, nutritional information, cost, location (storage compartment and shelf) and cooking times of each food packet stored within the device. A video display allows a user to retrieve the description, weight, nutritional information, and cost about each food packet within the database. A selection means, such as at least one button, a keyboard, or a touch sensitive screen associated with the video display, allows a user to navigate through the database and make selections therefrom.

The delivery system comprises a delivery ram adapted to slide within the housing and a plate pivotally attached to the ram and positionable between a first position wherein it holds a food packet received from its associated storage compartment and a second position wherein it drops the food packet into a delivery chute that in turn terminates proximate the heating compartment.

The vending system of the present invention also comprises a payment system of any appropriate design and type known in the art for collecting payment for each purchase, a printer for printing receipts, a tray dispenser for dispensing—either manually or automatically—a tray to a user, and a utensil dispenser for dispensing—either manually or automatically—a utensil packet to a user. A modem allows communication between the vending system and a remote site.

BRIEF DESCRIPTION OF THE DRAWINGS

Similar reference numerals refer to similar parts throughout the several views of the drawings.

DESCRIPTION OF THE PREFERRED EMBODIMENT

Figure 1:
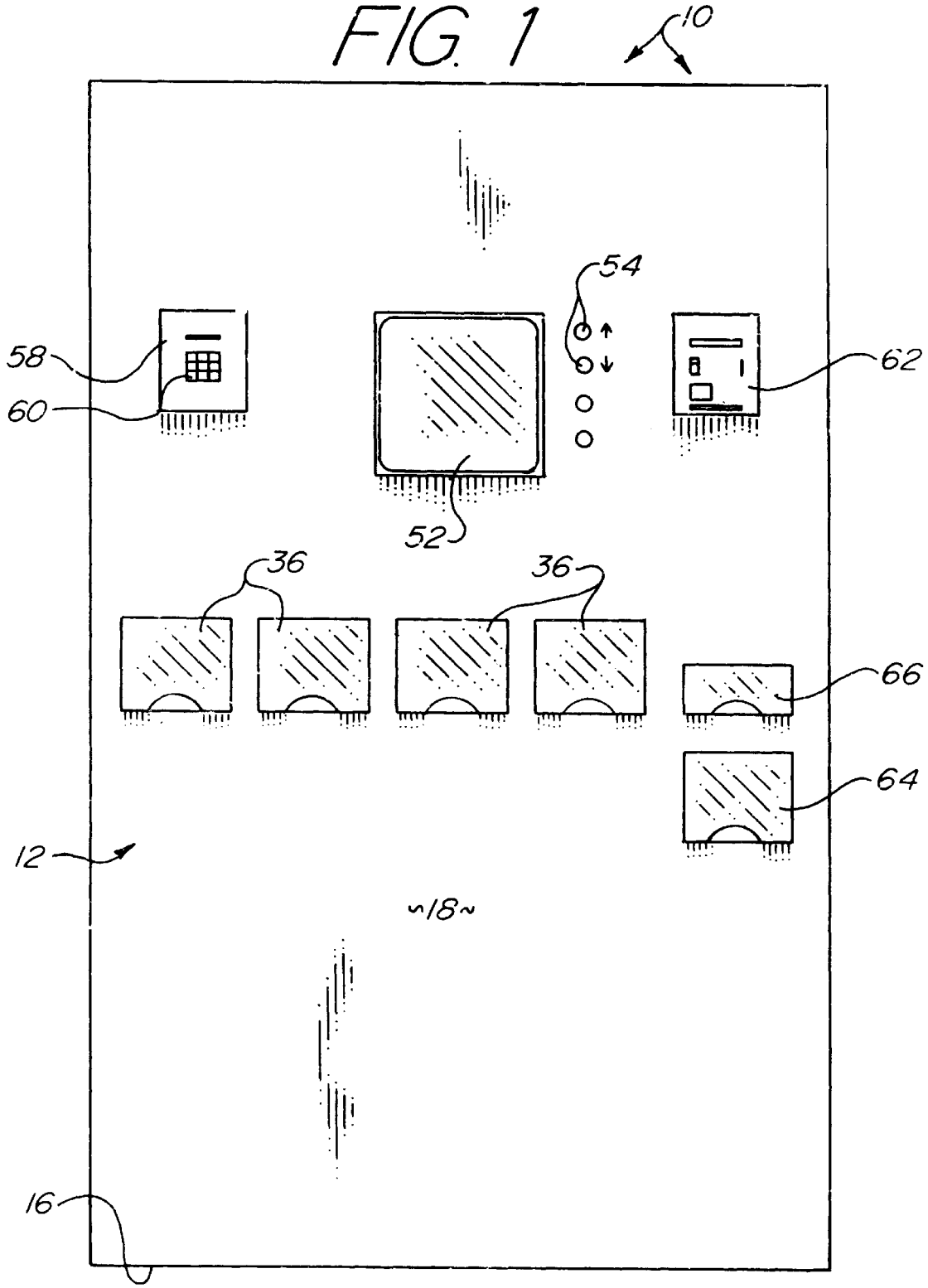
FIG. 1 is a front elevation view of the vending system of the present invention.
Figure 2:
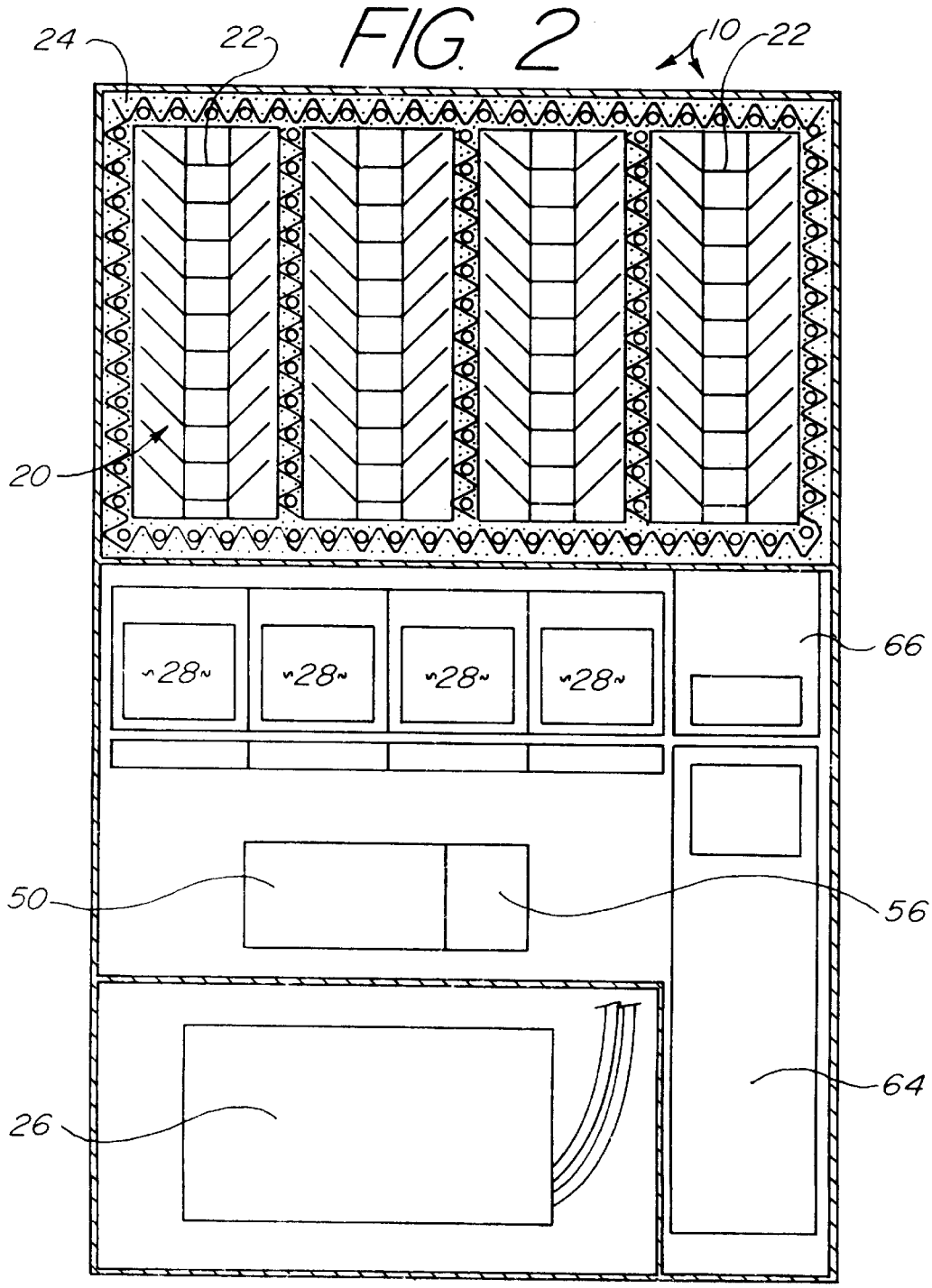
FIG. 2 is a front cutaway view of the vending system.
Figure 3:
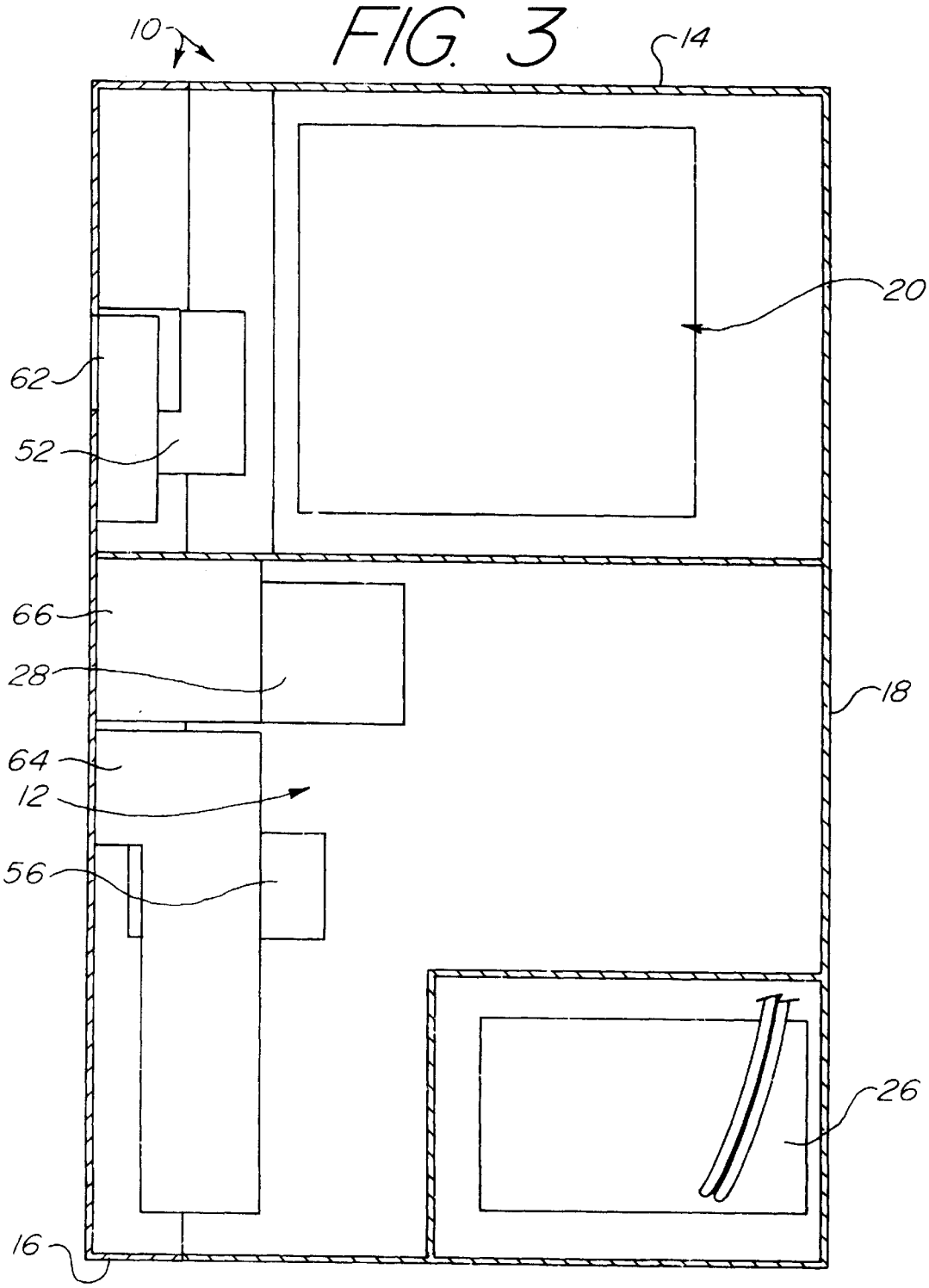
FIG. 3 is a left side cutaway view of the vending system.

Referring now to the drawings, it is seen that the vending system of the present invention, generally denoted by reference numeral 10, is comprised of a housing 12 having a top 14, a bottom 16, and a plurality of walls 18. At least one storage compartment 20 is disposed within the housing 12. As seen, each storage compartment 20 is located in the upper portion of the housing 12 and has at least one shelf 22, each shelf 22 being diagonally disposed relative to the horizon-whenever the housing 12 is disposed in generally upright fashion. At least one food packet F is disposed on each shelf 22 such that one of the food packets F can be dispensed from the storage compartment 20 whenever that food packet F is selected by a user. The method used for this dispension, which is not illustrated, can be of any conventional dispension system known in the art such as a drop gate that drops upon the food packet F selection with a second drop gate raised to prevent more than one food packet F being dispensed, etc.

Some but not necessarily all of the storage compartments 20 can have a freezer associated with the storage compartment 20. This can be accomplished by having each individual storage compartment being an individual freezer, or as illustrated, all of the storage compartments that are to be frozen can be disposed within a single communal freezer 24.

The freezer can be operated in any conventional fashion known in the art such as by way of the illustrated compressor 26 operatively connected to the freezer.

At least one heating compartment 28 is disposed within the housing 12. Each heating compartment 28, which will have high speed heating capabilities such as microwave heating, can be associated with a respective one of the storage compartments 20. Each heating compartment 28 has a first door 30 and a second door 32 and a mechanism, such as the illustrated dual-shafted solenoid 34, for opening and closing each door 30 and 32. A third door 36 is disposed within one of the walls 18 of the housing 12 for providing user access to the heating compartment. If desired, the third door 36 can be held shut, by appropriate means, whenever the heating compartment 28 is operating.

Figure 4:
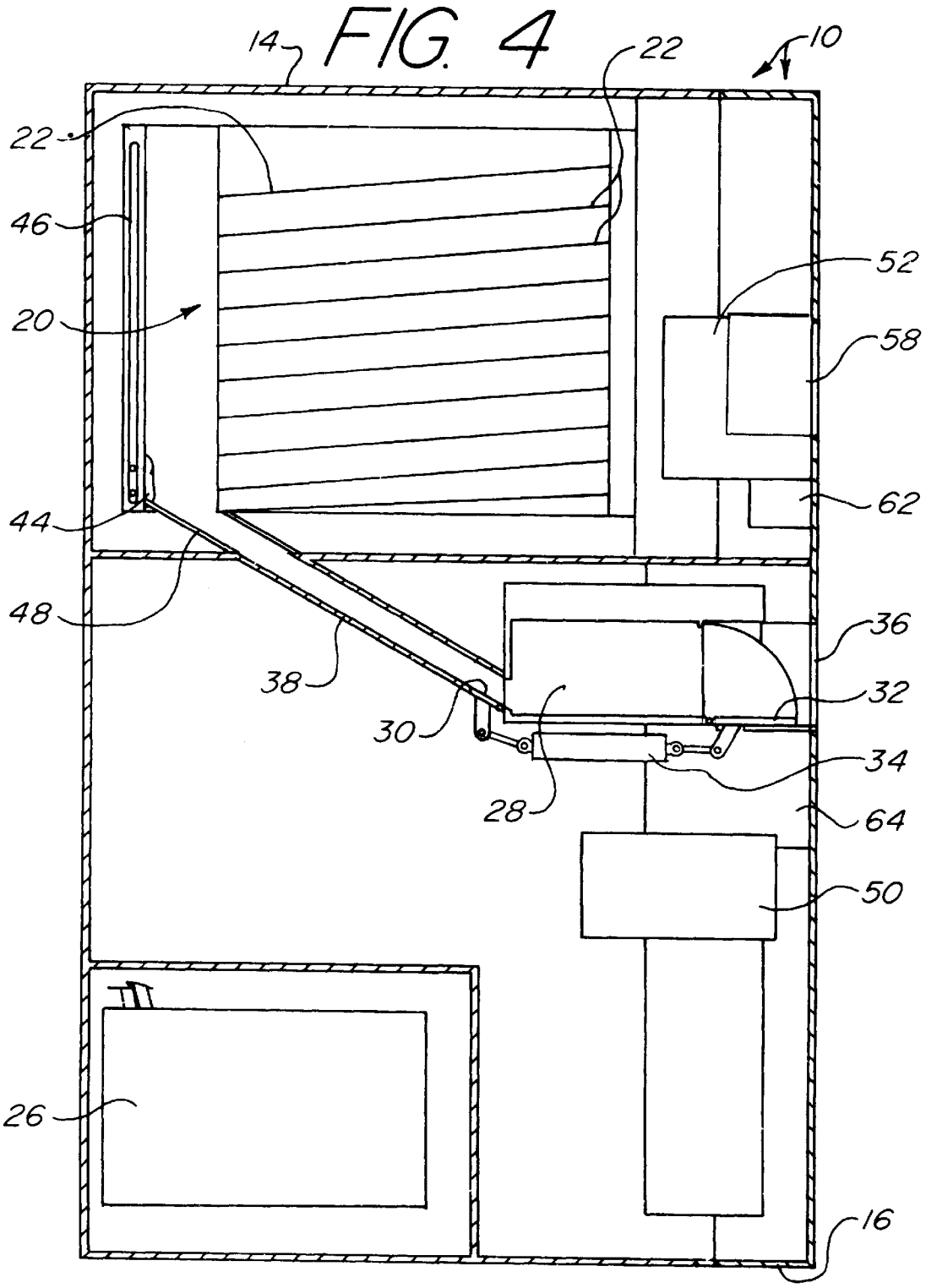
FIGS. 4–6 are right side cutaway views illustrating the dispension of a food packet from the storage compartment to the heating compartment.
Figure 5:
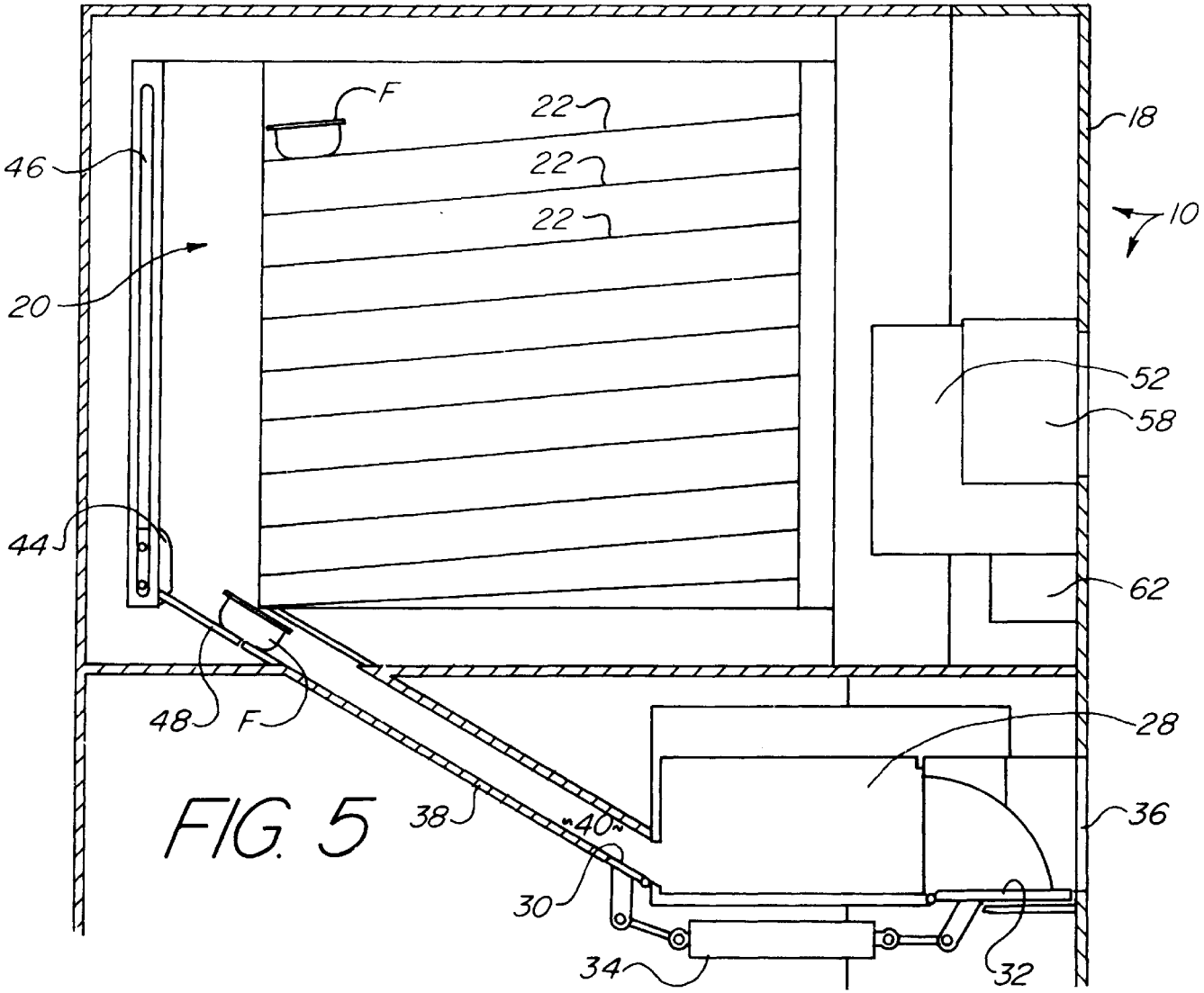
Figure 6:
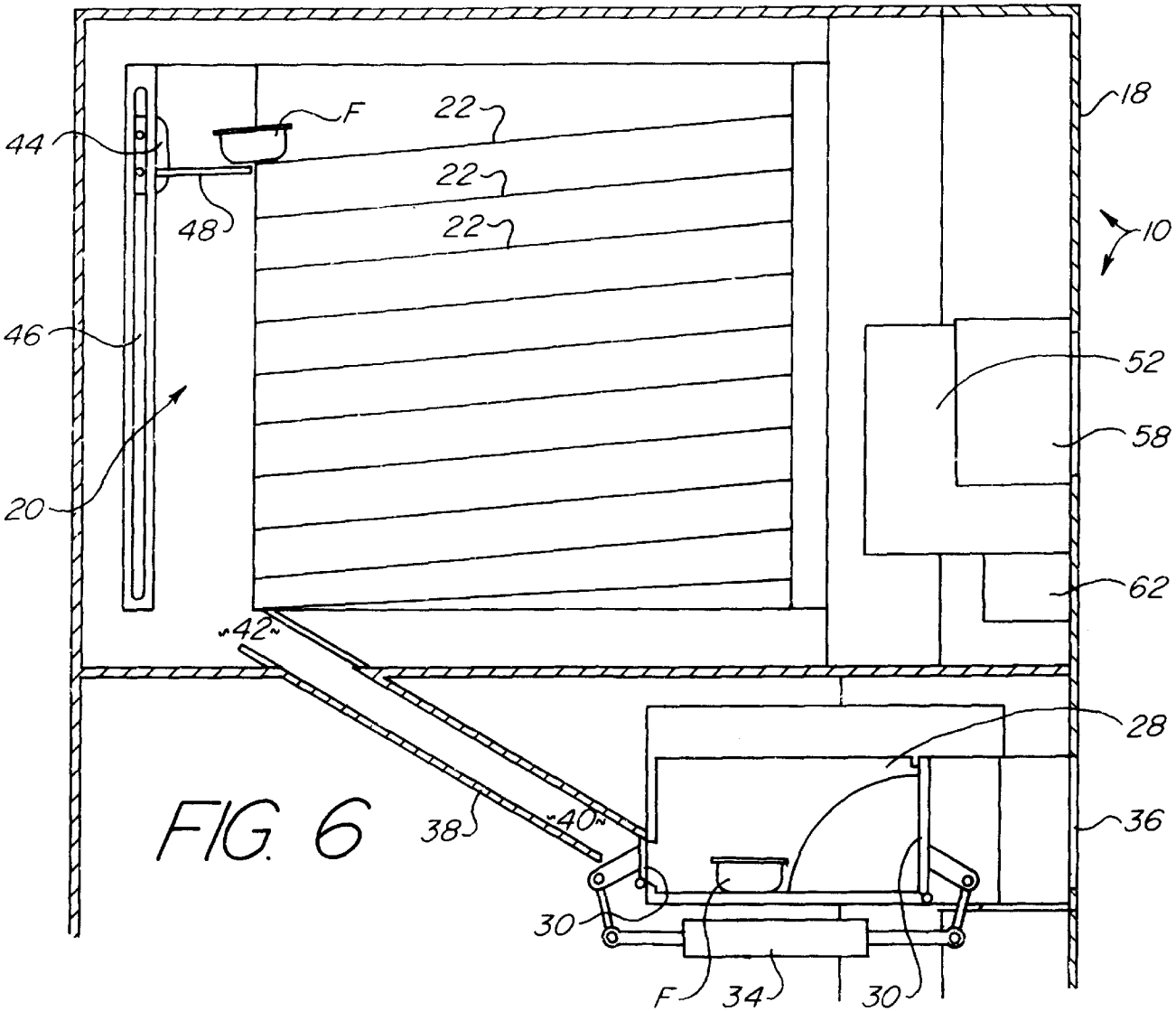

A delivery system has a delivery chute 38 that has a first end 40 terminating proximate the first door 30 and a second end 42 terminating proximate one of the storage compartments 20. A delivery ram 44 is adapted to slide within a guide 46 and has a plate 48 pivotally attached thereto. The plate 48 operates between a first position, illustrated in FIG. 6, and a second position, illustrated in FIGS. 4 and 5. An appropriate control motor (not illustrated), is operatively connected to the delivery ram 44 for sliding the delivery ram 44 within the guide 46 and for operating the plate 48 between the first position and the second position.

A computer system 50 is disposed within the housing 12. The computer system 50, which has a database and a video display 52, is used to store and display information about the food packets F held within the device 10. The database will have at least one entry, each entry holding information about at least one of the food packets F held within the device 10. Such information can include food packet F description, weight, nutritional information, the cost and can also include advertising information and contact information for manufactures of the food packets F. The database will also have cooking times for each of the food packets F. The database will also have information on which storage compartment 20 and which shelf 22 each food packet F is located. If a shelf becomes empty, detected by an appropriate sensor, the database will remove the appropriate food packet F from its list of available food packets for purchase. Advantageously, the database will be changeable so that as new food packets F are introduced into the device 10, new entries will be created. A control system is associated with the computer system 50. The control system is used to scroll through the entries, to select an entry and to show details about and entry. The control system can be of any conventional design known in the art such as the illustrated selection buttons 54. Alternately, the control system can be a touch sensitive screen associated with the video display 52. A modem 56 can be secured to the computer system 50 for allowing the computer system 50 to communicate with a remote site.

A payment system 58 is secured to one of the walls 18 of the housing 12 for accepting payment from a user. The payment system 58 can be of any conventional design known in the art such as a card reader that reads and debits credit cards, debit cards, and other similar cards, cash receiver, etc. If the payment system is a card reader, it communicates with the appropriate financial institution for payment verification via the modem 56 in conventional fashion. Appropriate controls, such as the illustrated keypad 60, are used to navigate through the payment system 58.

A printer 62 is secured to one of the walls 18 for printing receipts to users.

A tray dispenser 64 is disposed within the housing 12. The tray dispenser 64 stores and dispenses trays to users. Dispension of the trays can be manual wherein the user manually retrieves one of the trays from the tray dispenser 64 or can be automated in some fashion such that the tray dispenser 64 delivers a tray to each user upon usage of the device 10.

A utensil dispenser 66 is disposed within the housing 12. The utensil dispenser 66 stores and dispenses utensil packets to users. The utensil packet can have any appropriate items therein such as a knife, a fork, a spoon, a napkin, salt, pepper, etc. Dispension of the utensil packets can be manual wherein the user manually retrieves one of the utensil packets from the utensil dispenser 66 or can be automated in some fashion such that the utensil dispenser 66 delivers a utensil packet to each user upon usage of the device 10.

In order to use the vending system 10 of the present invention, food packets F are placed into appropriate locations in the storage compartments 20, one type of food packet F per shelf 22 of each storage compartment 20 (of course the same type of food packet F can be located on more than one shelf 22 or in more than one storage compartment 20). Appropriate information about each food packet F is entered into an entry in the database. The database can be relatively static such the same food packets F are always placed into the device 10 in the same positions. Alternately, the database can be dynamic such that as each food packet F is placed into one of the storage compartments 20, the location (the particular storage compartment 20 and the particular shelf 22 of this particular food packet F is entered into the database for association with that food packet F. Information about each food packet F can be entered into the database in any appropriate fashion. By way of example, a key board can be plugged into the computer system 50 and as an operator arrives and places a new food packet F into the device 10, the operator enters information into the database via the keyboard. Alternately, basic information about the food packet F, such as a code number, can be entered into the database with more detailed information being provided to the database via the modem 56 or being preloaded within the computer system 50 or downloaded into the computer system 50 from a disk or other medium. Additionally, the operator may utilize a hand held scanner that scans information from the food packet F and thereafter downloads the information to the database. Once all food packets F are placed into the device 10, the database will have information on each food packet F and its location (storage compartment 20 and shelf 22.

A user approaches the vending system 10 and reads information about available food packets F. The user can scroll through, and receive detailed information about the available entries using the appropriate controls of the control system.

The user selects one or more food packets F for purchase using the control system. After all purchase entries are selected, the device 10 provides the user with a total purchase price and retrieves payment from the user through the payment system 58 and prints the user a receipt via the printer 62. Once payment is verified, for each food packet F that is selected, the delivery ram 44 associated with the storage compartment 20 for the selected food packet F is positioned proximate the shelf 22 that holds the food packet F. The plate 48 is placed into the first position. The storage compartment 20 dispenses the food packet F which slides onto the plate 48. The plate 48 is lowered via the delivery ram 44 and once the delivery ram 44 is at its lowermost position, the plate 48 is placed into the second position causing the food packet F to slide through the delivery chute 38 into the appropriate heating compartment 28. The first door 30 and the second door 32 are closed and heating commences. Heating compartment 28 control is provided by the computer system 50 with the time and power parameters being provided via the database. Ideally, if the user selects multiple food packets F, the computer system 50 will assure that heating terminates in each heating compartment 28 at approximately the same time. If two or more food packets F will compete for the use of a single heating compartment 28 (such as when two food packets F are selected from a single storage compartment 20, the device 10 will advise the user of this situation. Once the heating of a food packet F is complete the second door 32 is opened and the user can retrieve the food packet F through the third door 36 (if one of the food packets purchased by the user does not require heating, the second door 32 never closes and the food packet F is immediately retrievable upon being dispensed by the delivery system). At some point during the heating process, the user receives a tray via the tray dispenser 64 and a utensil packet via the utensil dispenser 66.

While the invention has been particularly shown and described with reference to an embodiment thereof, it will be appreciated by those skilled in the art that various changes in form and detail may be made without departing from the spirit and scope of the invention.

I claim:

1. A vending system for dispensing food packets comprising:

a housing having a plurality of walls;

at least one storage compartment, each having at least one shelf, each of the at least one shelf being diagonally disposed relative to the horizon whenever the housing is disposed generally upright each capable of holding a plurality of the food packets, and each disposed within the housing;

at least one heating compartment disposed within housing;

a selection system, for selecting the dispension of at least one food packet from at least one of the at least one storage compartment;

at least one delivery system, each for delivering at least one of the at least one food packet selected by the selection system to a respective one of the at least one heating compartment; and at least one opening secured to at least one of the plurality of walls, each of the at least one opening allowing access to a respective one of the at least one heating compartment.

2. The vending system as in claim 1 further comprising at least one cooling element for cooling at least one of the at least one storage compartment.

3. The vending system as in claim 1 wherein each of the at least one heating compartment is microwave powered.

4. The vending system as in claim 1 wherein the selection system comprises:

a database having at least one entry, each of the at least one entry corresponding to at least one of the food packets being held within housing;

a video display system secured to one of the plurality of walls for displaying at least one of the at least one entry; and selection means for selecting at least one of the displayed at least one entry.

5. The vending system as in claim 4 wherein each entry comprises a description of the corresponding at least one food packet.

6. The vending system as in claim 5 wherein the description comprises:

the weight of the corresponding at least one food packet;

the cost of the corresponding at least one food packet; and the nutritional information of the corresponding at least one food packet.

7. The vending system as in claim 4 wherein each entry comprises the storage compartment and shelf location of each of the food packets.

8. The vending system as in claim 4 wherein the selection means comprises a touch sensitive screen associated with the video display.

9. The vending system as in claim 4 wherein the selection means comprises at least one button.

10. The vending system as in claim 4 further comprising a scrolling means for scrolling through each of the at least one entry.

11. The vending system as in claim 10 wherein the scrolling means comprises a touch sensitive screen associated with the video display.

12. The vending system as in claim 10 wherein the scrolling means comprises a plurality of buttons.

13. The vending system as in claim 1 wherein each of the at least one delivery system comprises:

a delivery chute having a first end terminating proximate a respective one of the at least one heating compartment and a second end;

a delivery ram adapted to slide within the housing;

a plate pivotally secured to the delivery ram and capable of operating between a first position and a second position; and wherein upon selection of one of the food packets the plate is placed into the first position and the delivery ram is slid until the plate is positioned proximate the selected food packet, the food packet is released from the respective one of the at least one storage compartment onto the plate, the delivery ram is slid until the plate is positioned proximate the second end of the delivery chute, the plate is placed into the second position and the food packet slides onto the delivery chute and into the heating compartment.

14. The vending system as in claim 1 further comprising a payment system secured to the housing.

15. The vending system as in claim 14 wherein the payment system comprises a card reader.

16. The vending system as in claim 14 wherein the payment system comprises a cash receiver.

17. The vending system as in claim 14 further comprising a printer for printing a receipt.

18. The vending system as in claim 1 further comprising a tray dispensing system.

19. The vending system as in claim 1 further comprising a utensil packet dispensing system.

20. The vending system-as in claim 1 further comprising a modem secured to the housing for allowing the selection system to communicate with a remote location.

21. A vending system for dispensing food packets comprising:

a housing having a plurality of walls;

at least one storage compartment, each capable of holding a plurality of the food packets, disposed within the housing;

at least one heating compartment disposed within housing;

a selection system, for selecting the dispension of at least one food packet from at least one of the at least one storage compartment, the selection system comprising a database having at least one entry, each of the at least one entry corresponding to at least one of the food packets being held within housing, a video display system secured to one of the plurality of walls for displaying at least one of the at least one entry, selection means for selecting at least one of the displayed at least one entry, and a description of the corresponding at least one food packet, the description comprising the weight of the corresponding at least one food packet, the cost of the corresponding at least one food packet, and the nutritional information of the corresponding at least one food packet;

at least one delivery system, each for delivering at least one of the at least one food packet selected by the selection system to a respective one of the at least one heating compartment; and at least one opening secured to at least one of the plurality of walls, each of the at least one opening allowing access to a respective one of the at least one heating compartment.

22. The vending system as in claim 21 further comprising at least one cooling element for cooling at least one of the at least one storage compartment.

23. The vending system as in claim 21 wherein each of the at least one heating compartment is microwave powered.

24. The vending system as in claim 21 wherein each entry comprises the storage compartment and shelf location of each of the food packets.

25. The vending system as in claim 21 wherein the selection means comprises a touch sensitive screen associated with the video display.

26. The vending system as in claim 21 wherein the selection means comprises at least one button.

27. The vending system as in claim 21 further comprising a scrolling means for scrolling through each of the at least one entry.

28. The vending system as in claim 27 wherein the scrolling means comprises a touch sensitive screen associated with the video display.

29. The vending system as in claim 27 wherein the scrolling means comprises a plurality of buttons.

30. The vending system as in claim 21 wherein each of the at least one delivery system comprises:

a delivery chute having a first end terminating proximate a respective one of the at least one heating compartment and a second end;

a delivery ram adapted to slide within the housing;

a plate pivotally secured to the delivery ram and capable of operating between a first position and a second position; and wherein upon selection of one of the food packets the plate is placed into the first position and the delivery ram is slid until the plate is positioned proximate the selected food packet, the food packet is released from the respective one of the at least one storage compartment onto the plate, the delivery ram is slid until the plate is positioned proximate the second end of the delivery chute, the plate is placed into the second position and the food packet slides onto the delivery chute and into the heating compartment.

31. The vending system as in claim 21 further comprising a payment system secured to the housing.

32. The vending system as in claim 21 wherein the payment system comprises a card reader.

33. The vending system as in claim 21 wherein the payment system comprises a cash receiver.

34. The vending system as in claim 21 further comprising a printer for printing a receipt.

35. The vending system as in claim 21 further comprising a tray dispensing system.

36. The vending system as in claim 21 further comprising a utensil packet dispensig system.

37. The vending system as in claim 21 further comprising a modem secured to the housing for allowing the selection system to communicate with a remote location.

38. A vending system for dispensing food packets comprising:

a housing having a plurality of walls;

at least one storage compartment, each capable of holding a plurality of the food packets, disposed within the housing;

at least one heating compartment disposed within housing;

a selection system, for selecting the dispension of at least one food packet from at least one of the at least one storage compartment;

at least one delivery system, each for delivering at least one of the at least one food packet selected by the selection system to a respective one of the at least one heating compartment, each of the at least one delivery system comprising a delivery chute having a first end terminating proximate a respective one of the at least one heating compartment and a second end, a delivery ram adapted to slide within the housing, a plate pivotally secured to the delivery ram and capable of operating between a first position and a second position, and wherein upon selection of one of the food packets the plate is placed into the first position and the delivery ram is slid until the plate is positioned proximate the selected food packet, the food packet is released from the respective one of the at least one storage compartment onto the plate, the delivery ram is slid until the plate is positioned proximate the second end of the delivery chute, the plate is placed into the second position and the food packet slides onto the delivery chute and into the heating compartment; and at least one opening secured to at least one of the plurality of walls, each of the at least one opening allowing access to a respective one of the at least one heating compartment.

39. The vending system as in claim 38 further comprising at least one cooling element for cooling at least one of the at least one storage compartment.

40. The vending system as in claim 38 wherein each of the at least one heating compartment is microwave powered.

41. The vending system as in claim 38 wherein the selection system comprises:

a database having at least one entry, each of the at least one entry corresponding to at least one of the food packets being held within housing;

a video display system secured to one of the plurality of walls for displaying at least one of the at least one entry; and selection means for selecting at least one of the displayed at least one entry.

42. The vending system as in claim 41 wherein each entry comprises a description of the corresponding at least one food packet.

43. The vending system as in claim 41 wherein each entry comprises the storage compartment and shelf location of each of the food packets.

44. The vending system as in claim 41 wherein the selection means comprises a touch sensitive screen associated with the video display.

45. The vending system as in claim 41 wherein the selection means comprises at least one button.

46. The vending system as in claim 41 further comprising a scrolling means for scrolling through each of the at least one entry.

47. The vending system as in claim 46 wherein the scrolling means comprises a touch sensitive screen associated with the video display.

48. The vending system as in claim 46 wherein the scrolling means comprises a plurality of buttons.

49. The vending system as in claim 37 further comprising a payment system secured to the housing.

50. The vending system as in claim 49 wherein the payment system comprises a card reader.

51. The vending system as in claim 49 wherein the payment system comprises a cash receiver.

52. The vending system as in claim 49 further comprising a printer for printing a receipt.

53. The vending system as in claim 38 further comprising a tray dispensing system.

54. The vending system as in claim 38 further comprising a utensil packet dispensing system.

55. The vending system as in claim 39 further comprising a modem secured to the housing for allowing the selection system to communicate with a remote location.

56. A vending system for dispensing food packets comprising:

a housing having a plurality of walls;

at least one storage compartment, each capable of holding a plurality of the food packets, disposed within the housing;

at least one heating compartment disposed within housing;

a selection system, for selecting the dispension of at least one food packet from at least one of the at least one storage compartment;

at least one delivery system, each for delivering at least one of the at least one food packet selected by the selection system to a respective one of the at least one heating compartment;

at least one opening secured to at least one of the plurality of walls, each of the at least one opening allowing access to a respective one of the at least one heating compartment; and a utensil packet dispensing system.

57. The vending system as in claim 56 further comprising at least one cooling element for cooling at least one of the at least one storage compartment.

58. The vending system as in claim 56 wherein each of the at least one heating compartment is microwave powered.

59. The vending system as in claim 56 wherein the selection system comprises:

a database having at least one entry, each of the at least one entry corresponding to at least one of the food packets being held within housing;

a video display system secured to one of the plurality of walls for displaying at least one of the at least one entry; and selection means for selecting at least one of the displayed at least one entry.

60. The vending system as in claim 59 wherein each entry comprises a description of the corresponding at least one food packet.

61. The vending system as in claim 59 wherein each entry comprises the storage compartment and shelf location of each of the food packets.

62. The vending system as in claim 59 wherein the selection means comprises a touch sensitive screen associated with the video display.

63. The vending system as in claim 59 wherein the selection means comprises at least one button.

64. The vending system as in claim 59 further comprising a scrolling means for scrolling through each of the at least one entry.

65. The vending system as in claim 64 wherein the scrolling means comprises a touch sensitive screen associated with the video display.

66. The vending system as in claim 64 wherein the scrolling means comprises a plurality of buttons.

67. The vending system as in claim 56 further comprising a payment system secured to the housing.

68. The vending system as in claim 67 wherein the payment system comprises a card reader.

69. The vending system as in claim 67 wherein the payment system comprises a cash receiver.

70. The vending system as in claim 67 further comprising a printer for printing a receipt.

71. The vending system as in claim 58 further comprising a tray dispensing system.

72. The vending system as in claim 58 further comprising a modem secured to the housing for allowing the selection system to communicate with a remote location.

* * * * *